US005348846A

United States Patent [19]

Nakagawa et al.

[11] Patent Number: 5,348,846

[45] Date of Patent: Sep. 20, 1994

[54] SILVER HALIDE PHOTOGRAPHIC PHOTOSENSITIVE MATERIAL

[75] Inventors: Kunihiro Nakagawa; Seiichi Sumi; Hideaki Baba, all of Nagaokakyo, Japan

[73] Assignee: Mitsubishi Paper Mills Limited, Tokyo, Japan

[21] Appl. No.: 931,491

[22] Filed: Aug. 21, 1992

Related U.S. Application Data

[63] Continuation of Ser. No. 654,579, Feb. 13, 1991, abandoned.

[30] Foreign Application Priority Data

Feb. 15, 1990 [JP] Japan ..... 2-35839
Apr. 5, 1990 [JP] Japan ..... 2-91881

[51] Int. Cl.[5] ..... G03C 1/815

[52] U.S. Cl. ..... 430/512; 430/510; 430/513; 430/517; 430/523; 430/606

[58] Field of Search ..... 430/510, 513, 517, 523, 430/606, 512

[56] References Cited

U.S. PATENT DOCUMENTS 4,472,497 9/1984 Kitchin et al. ..... 430/606
4,762,769 8/1988 Takahashi et al. ..... 430/606
4,857,446 8/1989 Diehl et al. ..... 430/510
4,898,809 2/1990 Sampei ..... 430/606
4,948,718 8/1990 Factor et al. ..... 430/510
4,980,276 12/1925 Arai et al. ..... 430/510
4,988,611 1/1991 Anderson et al. ..... 430/606

FOREIGN PATENT DOCUMENTS 59-193446 11/1984 Japan .
61-198148 9/1986 Japan .
61-240235 10/1986 Japan .

*Primary Examiner*—Jack P. Brammer
*Attorney, Agent, or Firm*—Cushman, Darby & Cushman

[57] ABSTRACT

The present invention provides a silver halide photographic photosensitive material which comprises a transparent support and a silver halide emulsion photosensitive layer provided thereon and a non-photosensitive layer on another side of the support on which the photosensitive layer is not provided, wherein both the photosensitive layer and the non-photosensitive layer contain dyes respectively and transmission density at 350–400 nm of the dye in the photosensitive layer is 0.15 or less and transmission density at 350–400 nm of the dye in the non-photosensitive layer is 0.40 or more.

4 Claims, 1 Drawing Sheet

SILVER HALIDE PHOTOGRAPHIC PHOTOSENSITIVE MATERIAL

This is a continuation of application Ser. No. 07/654,579, filed on Feb. 13, 1991, which was abandoned upon the filing hereof.

BACKGROUND OF THE INVENTION

The present invention relates to a silver halide photographic photosensitive material and more particularly to a roomlight silver halide photographic photosensitive material which has suitable reversal characteristics and is superior in safety against safelight (white fluorescent lamp from which ultraviolet ray has been excluded).

Recently, improvement of efficiency in the field of printing has been demanded due to complexity of step of reversing operation resulting from complexity of prints and development of scanner. Therefore, photographic films much lowered in sensitivity as compared with conventional films for reversing have been developed and have begun to be used as films which can be handled under roomlight (under white fluorescent lamp from which ultraviolet ray has been removed), namely, as roomlight photosensitive materials.

In general, emulsions of such ultra-low sensitivity as can be utilized as roomlight photosensitive materials are obtained by further adding a dye for lowering the inherent sensitivity to a silver halide photographic emulsion which has been desensitized with an inorganic desensitizer such as rhodium salt or an organic desensitizer such as pinakryptol yellow alone or with combination of these desensitizers.

On the other hand, in reversing step of printing plate making process, there are often carried out not only the negative-positive conversion by simple one sheet contact printing reversal, but also adjustment of line width of letter or adjustment of area of dots of dot image by control of exposure and besides, high-degree image conversion operation such as removal of letter.

Removed letter means the portion which is omitted in the form of letter or line in dot images such as those of photographic originals in printed matters (namely, the portion which does not receive ink). Specifically, as shown in the drawing attached hereto, dot original (E) stuck on base (D) and letter-line original (B) stuck on base (A) are put together and reversal photosensitive material (F) is subjected to contact exposure through them as original. In some case, several sheets of film (C) may be inserted as a mask between the dot original and the letter-line original.

Therefore, even if an exposure enough to convert the dot original to 1:1 (namely, to convert dots of x% to (100−x)%) is applied, the letter line image becomes unsharp and width of line becomes thinner than that of the original because of the exposure through several sheets of spacers. This is fatal in the step of removal of letter.

However, if, as mentioned above, a dye which reduces inherent sensitivity is added to emulsion layer in order to lower sensitivity of silver halide photographic emulsion to such extent as it can be utilized as a roomlight photosensitive material, there are the defects that functions to adjust the area of dots of dot image and width of letter line by control of exposure are lost and besides, exposure required for conversion of dot original in 1:1 markedly increases and so line width of removed letter becomes thinner and in the worst case, thin original is broken.

For solving these defects, there has been proposed to contain a dye to lower the inherent sensitivity in a non-photosensitive hydrophilic colloid layer provided above silver halide emulsion layer, namely, at a position remoter than the emulsion layer from support as in Japanese Patent Kokai (Laid-Open) Nos. 59-193447, 61-198148 and 61-240235. However, according to this method, fixation of the dye in the non-photosensitive layer by mordant is not sufficient and it is unavoidable that line width of removed letter becomes thinner as mentioned above due to penetration of the dye into the silver halide photosensitive emulsion layer.

On the other hand, however, when no dye which lowers the inherent sensitivity is contained in the silver halide emulsion layer, there occurs the problem that so-called fringes are formed due to blur of image caused by irradiation.

Therefore, there have been desired roomlight reversal photosensitive materials which are superior in adjustability of line width of letter and area ratio of dots by control of exposure and are free from formation of fringes.

There is the another problem that if amount of the dye used in roomlight photosensitive materials is restricted, safety against white fluorescent lamp from which ultraviolet ray has been excluded which is used as safelight is damaged.

SUMMARY OF THE INVENTION

An object of the present invention is to provide a roomlight silver halide photographic photosensitive material which has excellent reversing properties such as adjustment of line width of letter or area ratio of dots by control of exposure and removal of letters and which is free from fringes.

Another object of the present invention is to provide a roomlight silver halide photographic photosensitive material excellent in stability against safelight with attaining the above object.

The objects of the present invention have been attained by a silver halide photographic photosensitive material which comprises a transparent support and a silver halide emulsion photosensitive layer provided on said support and a non-photosensitive layer provided on another side of the support which is opposite to the emulsion side, characterized in that both the photosensitive layer and the non-photosensitive layer contain dyes and transmission density of the dye in the photosensitive layer at 350–400 nm is 0.15 or less and transmission density of the dye in the non-photosensitive layer at 350–400 nm is 0.40 or more.

More preferred construction of the photosensitive material of the present invention is that the above-mentioned non-photosensitive layer has substantial absorption in the whole range of 350–600 nm and transmission density of the non-photosensitive layer at 550 nm is 0.5 or more and transmission density of the non-photosensitive layer at 500 nm and 600 nm is 30% or more of transmission density at 550 nm.

BRIEF EXPLANATION OF THE DRAWING

The drawing attached hereto shows method for production of removed letter in photographic plate making process and A–F indicate the following.

A: Base

B: Letter line image original

Figure 1:
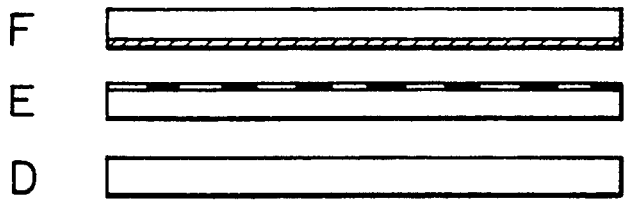
Figure 1:
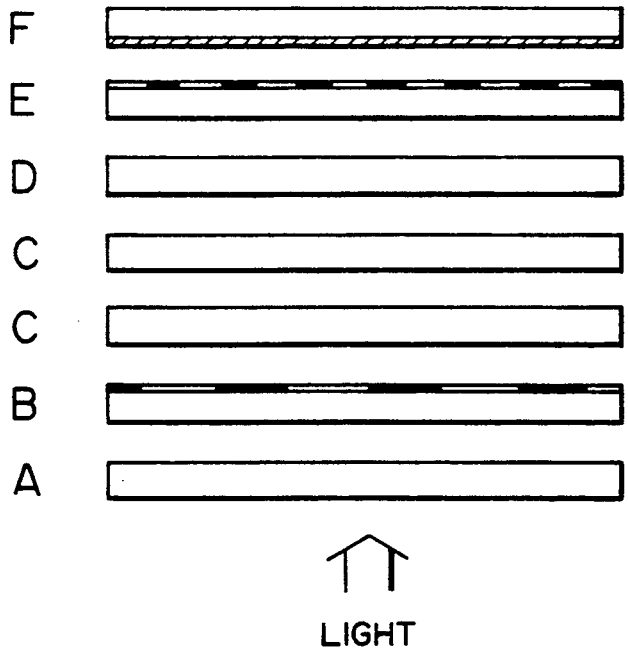

C: Mask film (transparent)
D: Base
E: Dot original
F: Photosensitive material for reversal.

DESCRIPTION OF THE INVENTION

The present invention will be explained in detail.

The silver halide emulsions used in the present invention have no special limitation and any of silver chloride, silver bromide, silver chlorobromide, silver chloroiodide, silver iodobromide and silver chloroiodobromide may be used.

The silver halide grains used in the present invention have 0.1–0.4 nm and preferably, 90% or more of total number of grains have a grain size within the range of ±10% of average grain size. The silver halide emulsion can be prepared by any of normal mixing method, reverse mixing method and simultaneous mixing method.

Emulsion after subjected to physical ripening is preferably desalted and then necessary additives are added to the emulsion and then, this is coated, but the desalting treatment may be omitted. It is preferred not to substantially carry out chemical sensitization, but if necessary, this may be carried out.

The silver halide emulsion used in the present invention may contain additives used for general photographic emulsions such as stabilizer, antifoggant, covering power improver, film property improver, surface active agent, hardener, matting agent, and developing agent and is coated on a known transparent support. Other hydrophilic colloid layers such as protective layer and undercoat layer may be provided.

The dyes used in the present invention can be selected from a wide variety of dyes. Preferred dyes are those which have at least two sulfo groups or carboxyl groups in their molecule.

Typical examples of the dyes are shown below, but the present invention is not limited thereto.

Dye 1

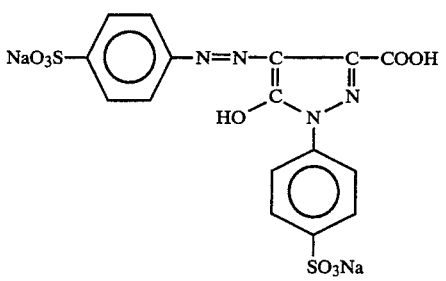

Dye 2

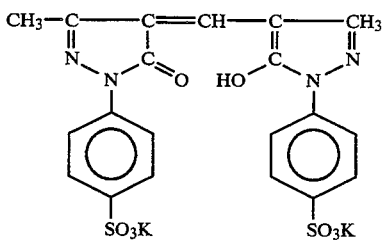

Dye 3

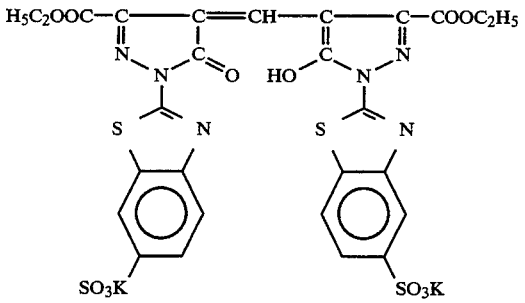

Dye 4

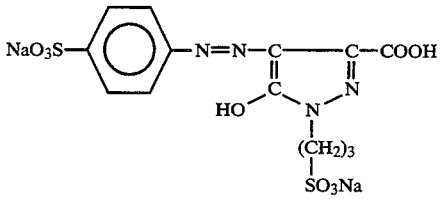

Dye 5

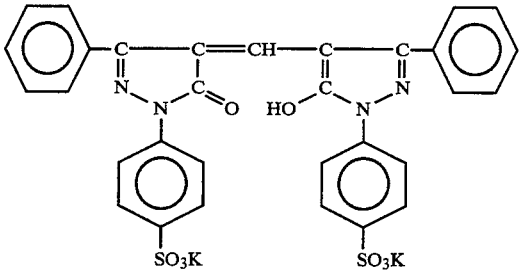

Dye 6

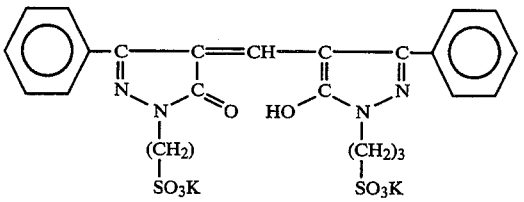

-continued
Dye 7
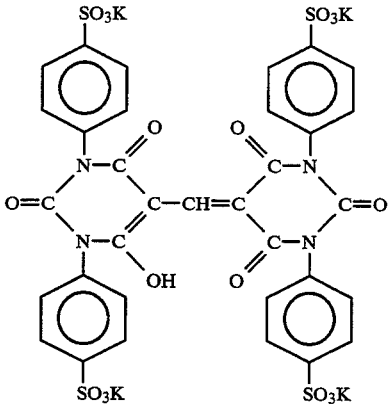
Dye 8
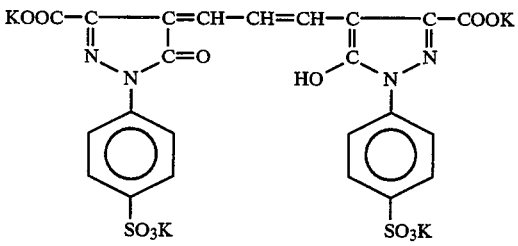
Dye 9
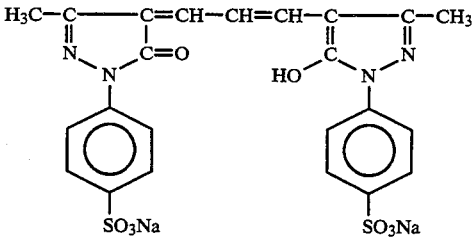
Dye 10
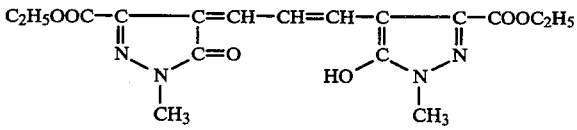
Dye 11
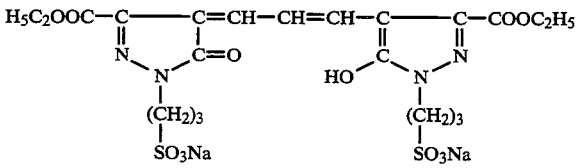
Dye 12
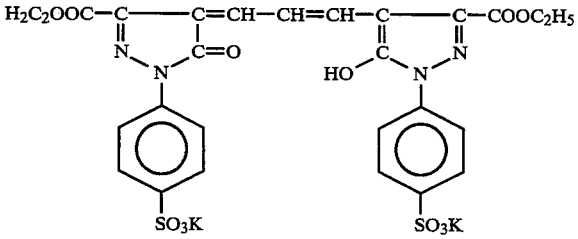
Dye 13
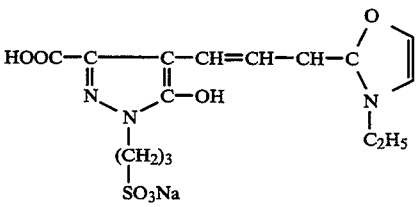
Dye 14
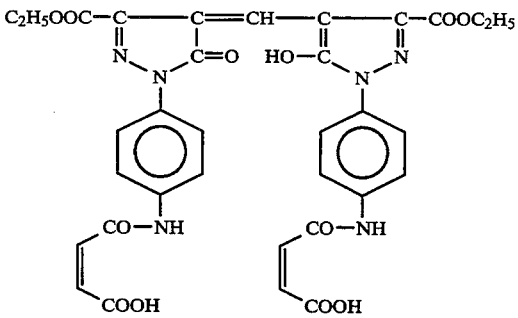

-continued
Dye 15
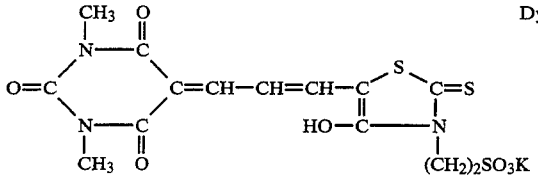
Dye 16
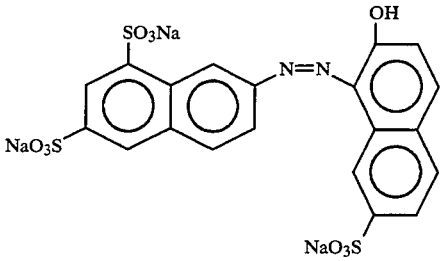
Dye 17
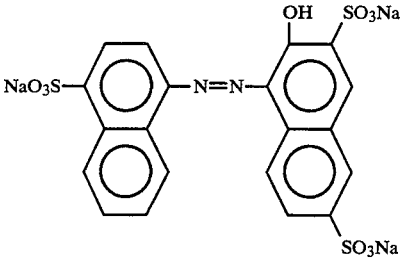
Dye 18
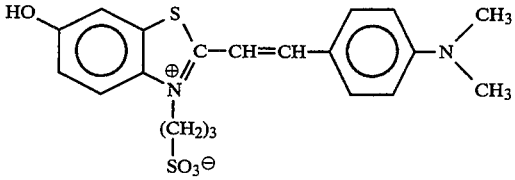
Dye 19
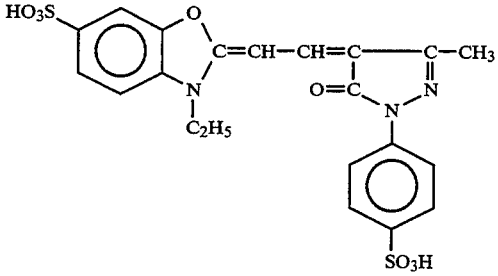
Dye 20
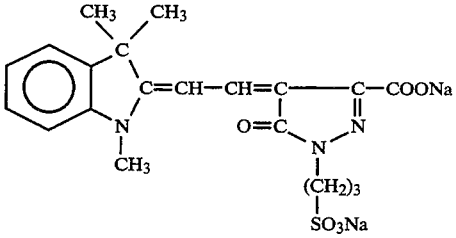
Dye 21
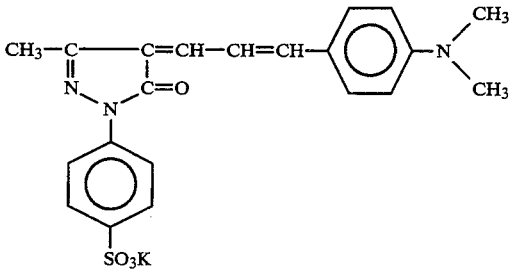
Dye 22
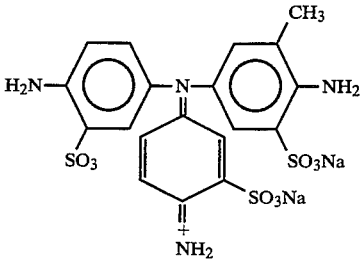
Dye 23
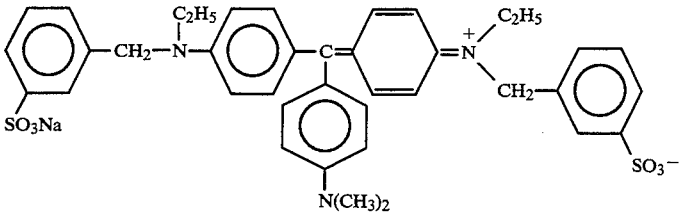
Dye 24
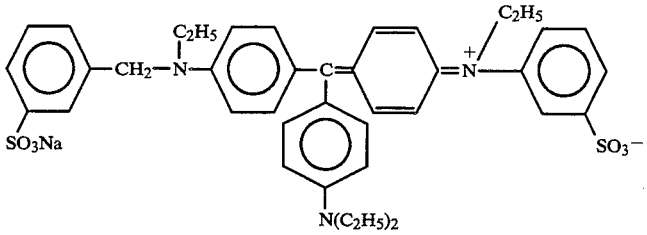
The roomlight photosensitive materials obtained by the present invention are exposed mainly to light sources rich in ultraviolet ray used in the field of printing, such as mercury lamp, ultra-high pressure mercury lamp and metal halide lamp.

EXAMPLE 1

The above-exemplified dye 2 was added to gelatin solution so that the transmission density at 350–400 nm was as shown in Table 1 and thereto were added a hardener and a surface active agent. The mixture was coated as a non-photosensitive layer on a polyester film and dried.

Separately, a silver chlorobromide emulsion containing a rhodium salt in an amount of $1\times10^{-5}$ mol per 1 mol of silver halide and containing 95 mol % of silver chloride was prepared by simultaneous mixing method (double-jet method) to obtain a monodispersed emulsion having an average grain size of 0.2 μm. Gelatin used was an inert gelatin. This emulsion was subjected to desalting and redissolution and then, a stabilizer, a hardener and a surface active agent were added thereto. Furthermore, to the emulsion was added the dye 2 so that the transmission density at 350–400 nm was as shown in Table 1. This emulsion was coated together with gelatin solution for protective layer on another side of the above-mentioned polyester film on which the non-photosensitive layer was not provided and was dried to obtain a sample.

This sample and a 50% dot original were subjected to contact exposure by a roomlight printer and the exposed sample was developed with D-85 developer at 20° C. for 2 minutes, fixed, washed with water and dried and exposures for obtaining 50% of dots and 53% of dots and the ratio (exposure for 53%/exposure for 50%) was obtained as dot variability.

Evaluation was conducted under the following critria.

Less than 2.2 of the ratio: A 2.2 or more and less than 3.2: B 3.2 or more: C

The smaller value indicates the superior variability, namely, A is the best.

Furthermore, the dot image reversed to 50% was observed by a magnifier to examine formation of fringe around dots. (Formation of fringe is indicated by X and formation of no fringe is indicated by O).

Furthermore, as shown in the drawing attached hereto, base+dot original, two mask films and base+-letter original which were put together were brought into close contact with the sample and these were exposed by a roomlight printer and developed in the same manner as above and quality of removed letter was tested. When a letter of 60 μm in width in the original was 50 μm or more in the removed letter under an exposure for dot of 50% being reversed to 52%, this was indicated to be 5, when the width of removed letter was 40–50 μm, this was expressed to be 4, when the width of removed letter was 30–40 μm, this was expressed to be 3, when the width of removed letter was 20–30 μm, this was expressed to be 2, and when the width of removed letter was less than 20 μm, this was expressed to be 1. The larger the value is, the better the quality of removed letter is.

The results are shown in Table 1.

As can be seen from Table 1, when amounts of the dye in photosensitive layer and non-photosensitive layer are within the ranges of the present invention, reversing characteristics such as dot variability, fringe and removed letter are superior.

TABLE 1

| Addition amount of Dye 2 | | | | |
|---|---|---|---|---|
| Photosensitive layer | Non-photosensitive layer | Dot variability | Fringe | Removed letter |
| 0.00 | 0.50 | A | x | 5 |
| 0.05 | 0.50 | A | ○ | 5 |
| 0.10 | 0.10 | A | ○ | 3.5 |
| 0.10 | 0.30 | A | ○ | 4 |
| 0.10 | 0.50 | A | ○ | 5 |
| 0.10 | 0.70 | A | ○ | 5 |
| 0.20 | 0.50 | B | ○ | 4 |
| 0.30 | 0.50 | C | ○ | 1 |
| 0.50 | 0.50 | C | ○ | 1 |

Addition amount of dye is shown by transmission density of the dye on the film at 350–400 nm.

EXAMPLE 2

Samples were prepared in the same manner as in Example 1 except that the dye shown in Table 2 was added to non-sensitive layer so that transmission density at 350–400 nm was 0.50 and the dye shown in Table 2 was added to photosensitive layer so that the transmission density was 0.10 and reversing characteristics of the samples were evaluated in the same manner as in Example 1.

The results are shown in Table 2.

As can be seen from the results of Table 2, reversing characteristics are superior when transmission density at 350–400 nm is within the range of the present invention regardless of kind of dyes.

TABLE 2

| Dyes | | | | |
|---|---|---|---|---|
| Photosensitive layer | Non-photosensitive layer | Dot variability | Fringe | Removed letter |
| Dye 2 | Dye 1 | A | ○ | 5 |
| Dye 2 | Dye 3 | A | ○ | 5 |
| Dye 1 | Dye 6 | A | ○ | 5 |
| Dye 3 | Dye 2 | A | ○ | 5 |
| Dye 6 | Dye 2 | A | ○ | 5 |
| Dye 1 | Dye 1 | A | ○ | 5 |
| Dye 3 | Dye 3 | A | ○ | 5 |
| Dye 6 | Dye 6 | A | ○ | 5 |

EXAMPLE 3

Samples were prepared in the same manner as in Example 1 except that the dyes were added in combination as shown Table 3 to non-sensitive layer so that transmission density was as shown in Table 3 and the dye 2 was added to photosensitive layer so that transmission density was 0.10.

The samples were exposed for sensitometry by a roomlight printer having 1.5 Kw ultra-high pressure mercury lamp as light source and were irradiated with roomlight, namely, light of white fluorescent lamp from which ultraviolet ray was removed for 30 minutes from back coat side and thereafter, subjected to development with D-85 developer at 20° C. for 2 minutes, fixation, and drying. Then, sensitivity $D_{min}$ was measured. Sensitivity (S) was a relative value when sensitivity of the emulsion which was not irradiated with roomlight was assumed to be 100. $\Delta D_{min}$ was expressed by difference from D min when roomlight was not irradiated.

TABLE 3

| | Dye | Transmission density 350–400 nm | 500 nm | 550 nm | 600 nm | S | $\Delta D_{min}$ |
|---|---|---|---|---|---|---|---|
| O | Dye 2 + | 0.50 | 0.10 | 0.20 | 0.09 | 210 | +0.10 |
| P | Dye 8 + | 0.50 | 0.20 | 0.36 | 0.15 | 150 | +0.08 |
| Q | Dye 10 + | 0.50 | 0.42 | 0.78 | 0.30 | 103 | 0.00 |
| R | Dye 21 | 0.50 | 0.90 | 1.50 | 0.63 | 100 | 0.00 |
| S | | 0.50 | 1.76 | 3.06 | 1.18 | 100 | 0.00 |
| T | Dye 2 + | 0.50 | 0.50 | 0.40 | 0.20 | 130 | 0.00 |
| U | Dye 10 + | 0.50 | 0.94 | 0.76 | 0.44 | 100 | 0.00 |
| V | Dye 21 | 0.50 | 1.90 | 1.56 | 0.90 | 100 | 0.00 |
| W | Dye 2 + | 0.50 | 0.25 | 0.42 | 0.16 | 165 | +0.04 |
| X | Dye 8 + | 0.50 | 0.50 | 0.80 | 0.33 | 103 | 0.00 |
| Y | Dye 21 | 0.50 | 0.96 | 1.56 | 0.65 | 100 | 0.00 |

The results of Table 3 show that in spite of the use of dye being limited in claim 1 given hereinafter, safety against irradiation with safelight from back side can be maintained by using the non-sensitive layer as shown in claim 2 given hereinafter.

The photographic photosensitive material of the present invention is so-called roomlight photographic photosensitive material which can be handled under light of white fluorescent lamp from which ultraviolet ray is removed and is less in fringe and has good reversing characteristics such as dot variability and removed letter.

What is claimed is:

1. A silver halide photographic photosensitive element comprising:

a transparent support;

a silver halide emulsion photosensitive layer provided on one side of said transparent support, said photosensitive layer including a first dye in an amount sufficient to provide a transmission density of said photosensitive layer ranging from 0.05 to 0.15 at 350–400 nm; and a non-photosensitive colloid layer provided on another side of said transparent support, said nonphotosensitive layer including a second dye in an amount sufficient to provide a transmission density of said nonphotosensitive layer of 0.40 or more at 350–400 nm.

2. A silver halide photographic photosensitive element according to claim 1, wherein said second dye is present in an amount sufficient to provide substantial absorption for the whole region of 350–600 nm, a transmission density of said nonphotosensitive layer at 550 nm is 0.5 or more, and transmission densities of said nonphotosensitive layer at 500 nm and 600 nm are 30% or more of said transmission density at 550 nm.

3. A silver halide photographic photosensitive element according to claim 1, wherein said first and second dyes are selected from the group consisting of azo dyes and oxonol dyes.

4. A silver halide photographic photosensitive element according to claim 1, wherein said photographic photosensitive element is handled under roomlight.

* * * * *